US005682024A

United States Patent [19]

Koopman, Jr. et al.

[11] Patent Number: 5,682,024

[45] Date of Patent: Oct. 28, 1997

[54] ELEVATOR POSITION DETERMINATION

[75] Inventors: Philip J. Koopman, Jr., Hebron; Alan M. Finn, Amston, both of Conn.

[73] Assignee: Otis Elevator Company, Farmington, Conn.

[21] Appl. No.: 509,622

[22] Filed: Jul. 31, 1995

[51] Int. Cl.[6] ..... B66B 1/36

[52] U.S. Cl. ..... 187/394; 187/283

[58] Field of Search ..... 187/391, 394, 187/393, 283

[56] References Cited

U.S. PATENT DOCUMENTS

| | | | |
|---|---|---|---|
| 3,859,624 | 1/1975 | Kriofsky et al. | 340/941 |
| 4,375,057 | 2/1983 | Weise et al. | 187/394 |
| 5,153,390 | 10/1992 | Barkman et al. | 187/394 |
| 5,181,975 | 1/1993 | Pollack et al. | 152/152 |
| 5,218,861 | 6/1993 | Brown et al. | 73/146 |
| 5,223,680 | 6/1993 | Schmidt-Miklau et al. | 187/394 |
| 5,261,282 | 11/1993 | Grabowski et al. | 73/861 |
| 5,274,203 | 12/1993 | Skalski et al. | 187/134 |
| 5,414,624 | 5/1995 | Anthonyson | 364/424 |
| 5,422,627 | 6/1995 | Tap et al. | 340/542 |
| 5,509,505 | 4/1996 | Steger et al. | 187/394 |

FOREIGN PATENT DOCUMENTS

| | | | |
|---|---|---|---|
| 6-156910 | 6/1994 | Japan | 187/391 |

OTHER PUBLICATIONS

U.S. application No. 08/378,111, Kamani et al., filed Jan. 23, 1995.

U.S. application No. 08/292,645, Jamieson et al., filed Aug. 18, 1994.

Wireless Technology for Automobile Theft Prevention by H. Howe, Jr. Microwave Journal, Jan. 1994.

TIRIS–Texas Instrument Registration and Identification System, Applications of Radio Frequency Indentification by H. Massink, 1993.

TIRIS–A Vehicle Tracking System Using Passive Radio Transponders by Michael M. Ollivier.

Electronics changes cars from inside out, Automotive Electronics, Jan. 24, 1994 by Jonah McLeod.

*Primary Examiner*—Robert Nappi

[57] ABSTRACT

An elevator position determination system for determining the position of an elevator car disposed in the elevator hoistway includes a transceiver disposed on the elevator car for generating a query signal and a transponder disposed in the elevator hoistway for providing an identification signal in response to the query signal, wherein, the elevator position determination system determines the elevator car position in response to the identification signal.

26 Claims, 3 Drawing Sheets

ELEVATOR POSITION DETERMINATION

TECHNICAL FIELD

The present invention relates generally to elevator systems and, in particular, relates to elevator car position determination.

BACKGROUND

An elevator system, to operate properly, must know the current elevator car position at all times. Accordingly, elevator position devices are commonly used to monitor car position. However, after a power loss or hard system reset, an elevator control system may not retain the current car position. For example, if a shaft encoder is used for position information, the shaft encoder may provide relative position movement after a power loss but absolute position information is not provided if the running total of shaft revolutions has been lost. If a floor leveling sensor is installed, the leveling sensor can determine whether the car is level with a floor; but the floor leveling sensor may not be able to determine which floor the car is level with in the hoistway.

One method of determining car position after a power loss is known as a terminal position recovery run. In a terminal position run, the elevator is moved to one end of the hoistway where an initialization switch is actuated and the position of the elevator car is thereafter known. This method, however, presents a problem when power is lost during operation and an elevator car is required to recover its position only to the nearest floor, such as in Fireman's Service Operation, before resuming normal operation. Additionally, this method may not be favorable in tall buildings because relatively low travel speeds are desirable during the terminal position recovery run to avoid overrunning a limit switch and hitting a buffer.

Another known approach is to maintain power to the necessary circuits and position devices during a power down condition. Typically, this approach requires that loss of power be detected and the instantaneous position of the elevator car be identified and stored in non-volatile memory. Hence, when power is restored, an elevator system controller can access the non-volatile memory to precisely ascertain the current location of the elevator car. This approach requires the provision of a secondary power supply, for example, in the form of a battery or by stored capacitive energy. These components are not only expensive and bulky but, in the case of batteries, require maintenance and routine replacement.

Another method includes the use of a plurality of magnets with encoded floor numbers placed at each landing sill to mark the floor number. The magnets may be encoded by utilizing precise placement of the magnets such that the presence or absence of a magnet in a particular area in the hoistway is indicative of a particular floor number. Alternatively, the physical characteristics of the magnets, such as length, may be utilized to indicate the floor number. A sensor responsive to the magnets is attached to the elevator car. However, this method requires a large number of magnets that must be precisely sized and/or precisely placed at each landing sill in the hoistway.

Consequently, a system and a method for elevator position determination that avoids the abovementioned drawbacks is clearly desirable.

DISCLOSURE OF THE INVENTION

It is an object of the present invention to provide an improved elevator position determination system and method that provides improved detection of a position of an elevator car disposed in a hoistway.

It is another object of the present invention to provide an elevator position determination system and method which is not subject to power loss or hard system reset errors.

It is a further object of the present invention to provide an elevator position determination system and method which does not require contact with the elevator.

It is a yet another object of the present invention to provide an improved elevator position determination system and method which is inexpensive to install and maintain.

According to the present invention, an elevator position determination system for determining the position of an elevator car disposed in the elevator hoistway that embodies the principles of the present invention includes a transceiver disposed on the elevator car for generating a query signal and a transponder disposed in the elevator hoistway for providing an identification signal in response to the query signal, wherein, the elevator position determination system determines the elevator car position in response to the identification signal.

The present invention provides the advantage of improved detection of a position of an elevator car disposed in a hoistway by providing an elevator position determination system and method which allows the transceiver to query the transponders after a power loss and determine the elevator position without a loss in position information. The present invention also provides an elevator position determination system and method which is inexpensive to install and maintain as a result of the utilization of low-cost transponders that do not require a power source other than power provided by the query signal generated by the transceiver.

These and other features, aspects and advantages of the present invention will become better understood with regard to the following description, appended claims and accompanying drawings.

BEST MODE FOR CARRYING OUT THE INVENTION

Figure 1:
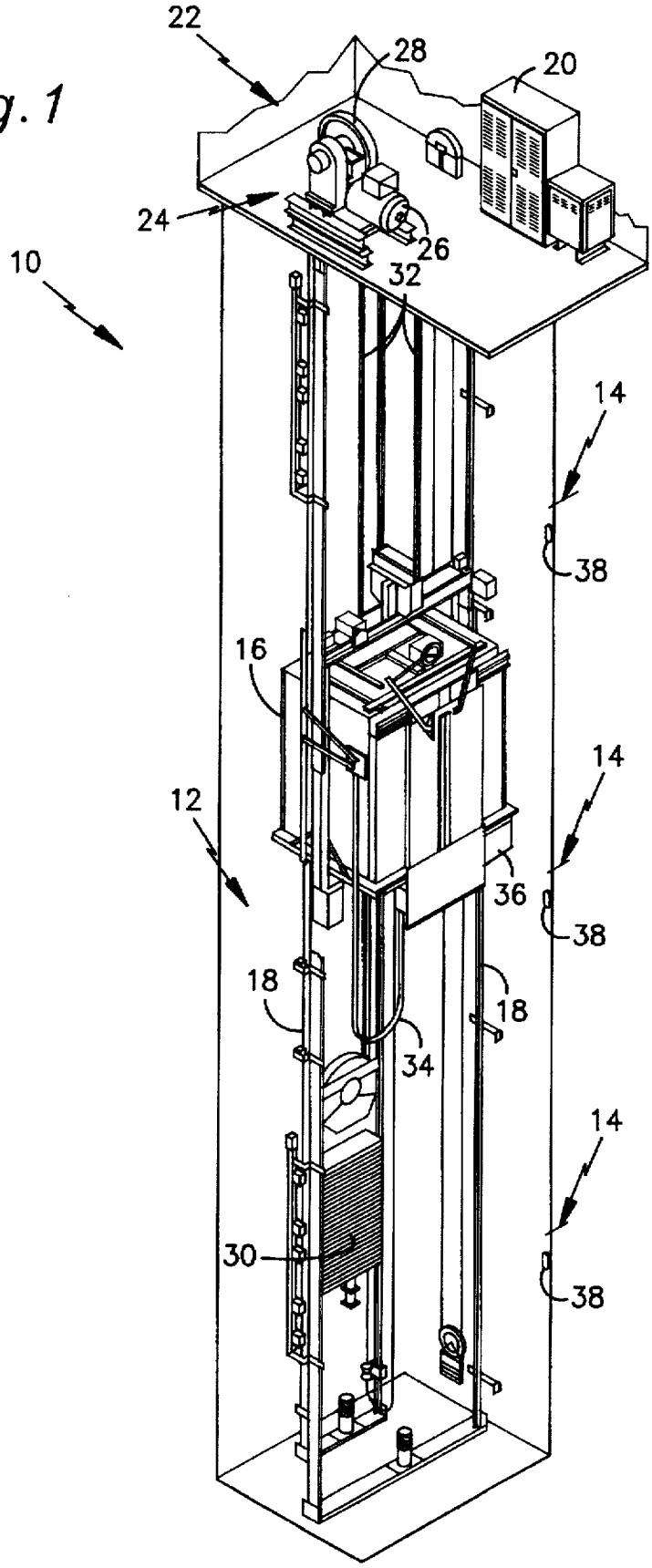
FIG. 1 is a diagram of an elevator system employing a preferred embodiment of the present invention.

Referring to FIG. 1, an elevator system 10 employing a preferred embodiment of a elevator position apparatus is shown. The elevator system 10 is disposed in a building having a plurality of floors. The building includes a hoistway 12 with a plurality of landings 14 that correspond to the plurality of floors. An elevator car 16 is disposed in the hoistway 12 such that the elevator car 16 may travel along elevator guide rails 18 disposed vertically in the hoistway 12. An elevator controller 20 is disposed in a machine room 22 which monitors and provides system control of the elevator system 10. The elevator controller 20 provides a control signal to a motive apparatus 24. The motive apparatus 24 provides a means to move the elevator car 16 in the hoistway 12 and is responsive to the control signal. In one embodiment, the motive apparatus 24 includes a drive motor 26, a drive sheave 28, a counterweight 30 and hoist ropes 32. The drive motor 26 is drivenly associated with the drive sheave 28 such that a rotational output of the drive motor 26 is transferred to the drive sheave 28. The rotational output of the drive motor 26 is transmitted to the elevator car 16 by the hoist ropes 32 guided around the drive sheave 28; the elevator car 16 being at one end of the hoist ropes 32 and the counterweight 30 at the other. A traveling cable 34 is used to provide an electrical connection between the elevator controller 20 and electrical equipment in the elevator car 16. Of course, it should be realized that the present invention can be used in conjunction with other elevator systems including hydraulic and linear motor systems, among others.

Figure 2:
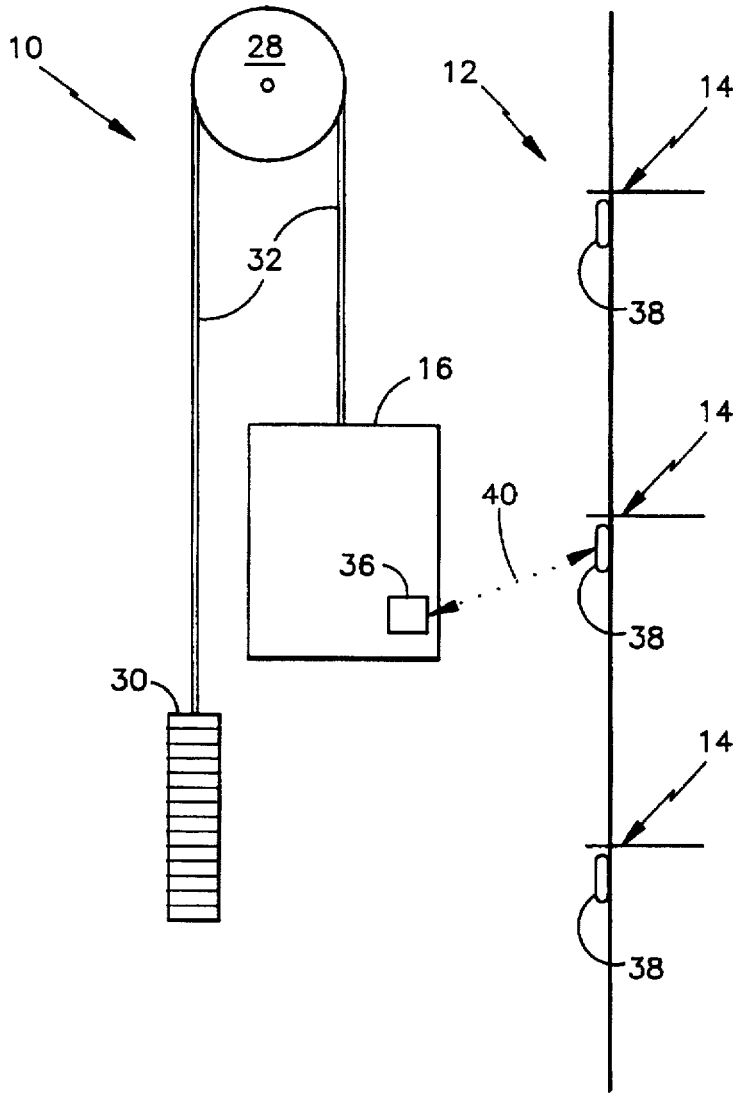
FIG. 2 is a functional block diagram of a system for elevator position determination embodying the principles of the present invention.

Referring to FIGS. 1, 2, an elevator position determination system for determining the position of an elevator car 16 disposed in the elevator hoistway 12 that embodies the principles of the present invention, includes a transceiver 36 and a transponder 38.

Figure 3:
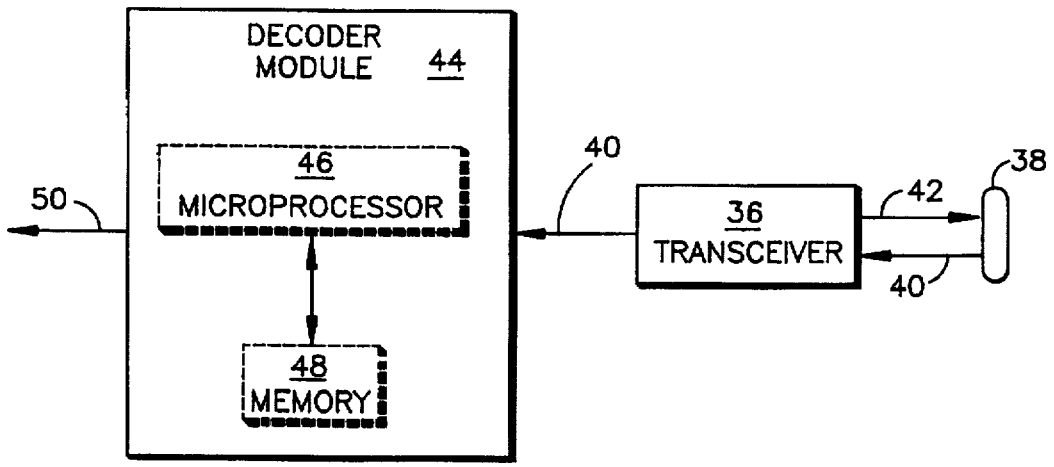
FIG. 3 is schematic block diagram of a system for elevator position determination embodying the principles of the present invention.

The transponder 38 provides an identification signal 40 in response to a query signal 42 (shown in FIG. 3). The transponder 38 is a passive device in that it has no internal energy source. Instead, the transponder 38 relies on the radio frequency query signal 42 transmitted by the transceiver 36 as an energy source. More specifically, the query signal 42 is received by circuitry in the transponder 38 such that the transponder 38 uses the query signal 42 as an energy source for use in its transmission of an identification signal 40 that is digitally encoded to identify the transponder 38. In a preferred embodiment, each transponder 38 has a unique identification signal 40 that has an approximate range of 1 meter.

As a result of integrated technology, it is possible to make a small transponder 38 on the order of 31 mm long and 3.6 mm in diameter including a transponder antenna. However, transponders can be produced having various sizes and shapes. The transponder 38, in a preferred embodiment, is disposed in the elevator hoistway 12 adjacent to landings 14 as is described in detail hereinbelow.

The transceiver 36 provides the query signal 42 for energizing the transponder 38 as described above. Additionally, the transceiver 36 is responsive to the identification signal 40 transmitted by the transponder 38 such that the transceiver 36 transmits the identification signal 40 either directly to the elevator controller 20 or to a decoder module 44 as is explained below. In a preferred embodiment, the transceiver 36 is disposed on the elevator car 16 such that the transceiver 36 travels with the elevator car 16 in the hoistway 12.

A preferred example of the transponder and the transceiver is commercially available through Texas Instruments, and is sold under the trademark TIRIS. Thus, radio frequency transponders and transceivers are per se known. The present inventors, however, believe that adapting this technology to the elevator art will substantially improve car position measurement arrangements.

The identification signal 40, in a preferred embodiment, directly corresponds to a floor number. The identification signal 40 includes a floor indication value which is indicative of the floor or landing 14 nearest to the transponder 38. This allows the transceiver 36 to directly transmit the identification signal 40 to the controller 20 so that the elevator system 10 is provided with elevator position information. For example, the identification signal 40 of a transponder 38 disposed in the hoistway 12 adjacent to floor one includes a floor indication value equal to one. Consequently, the elevator position determination system can determine the elevator car position in response to the identification signal 40. Preferably, the transponder 38 is programmable such that the floor indication value is adjustable at installation.

Alternatively, referring to FIG. 3, the elevator position determination system includes a decoder module 44 that comprises a microprocessor 46, a memory 48 and programming embedded in the memory 48. The transceiver 36 transmits the identification signal 40 to the decoder module 44 which decodes the identification signal 40 by comparing the value of the identification signal 40 to values stored in a look-up table in the memory 48 that correspond to specific floors in the building. When a match is found the microprocessor 46 is able to determine a proximal floor or landing 14. Thus, the decoder module 44 maps values stored in memory 48 that represent specific floors in the building and compares the identification signal 40 to the values such that the elevator car position can be determined in response to the identification signal 40. In one embodiment, the transponder 38 transmits an identification signal 40 that comprises a 64 bit code such that a unique code for each floor in the building is provided. For example, the identification signal 40 of a transponder 38 disposed in the hoistway 12 adjacent to floor one includes the identification signal 40 with a value equal to a value stored in the memory 48 that corresponds in the look-up table to floor one. In other words, the decoder module 44 cross-references the identification signal 40 to a corresponding floor number in its memory 48 such that the elevator position determination system can determine the elevator car position in response to the identification signal 40.

The decoder module 44 may reside in software in the elevator controller 20 or may be implemented as a separate component. If the decoder module 44 resides in the controller 20, the transceiver 36 directly transmits the identification signal 40 to the controller 20. If the decoder module 44 is a separate component, the transceiver 36 transmits the identification signal 40 to the decoder module 44; wherein, the decoder module 44 cross-references the identification signal 40 with the values stored in the memory 48 and transmits a decoded signal 50 to the controller 20. In one embodiment, the decoded signal 50 directly corresponds to the floor number associated with the identification signal 40. For example, a decoded signal 50 having a value of one represents the first floor in the building.

An alternative approach to placing the transponders 38 at each floor includes multiple transponders 38 per elevator car 16 to provide multiple position reference points with a resolution dependent on the signal strength of the transponder 38. For example, one transponder 38 may be disposed every two meters for transponders 38 with a one meter identification signal range. Thus, as the elevator car 16 travels through the hoistway 12 its position may be determined within a two meter resolution. In this embodiment, the transponders 38 provide an identification signal 40 that directly corresponds to the transponder's absolute position in the hoistway 12; as opposed to the proximate floor as described above.

The identification signal 40 includes an position indication value which is indicative of the absolute position of the transponder 38 in the hoistway. This allows the transceiver 36 to directly transmit the identification signal 40 to the controller 20 so that the elevator system 10 is provided with elevator position information. For example, the identification signal 40 of the transponder 38 disposed at a height of 10 meters in the hoistway 12 includes a position indication value equal to 10.0. Consequently, the elevator position determination system can determine the elevator car position in response to the identification signal 40. Preferably, the transponder 38 is programmable such that the floor indication value is adjustable at installation.

Alternatively, the elevator position determination system includes the decoder module 44 as described above and shown in FIG. 3. In this embodiment, the transceiver 36 transmits the identification signal 40 to the decoder module 44 which compares the value of the identification signal 40 to values stored in a look-up table in the memory 48 that correspond to specific location in the hoistway 12. When a match is found the microprocessor 46 is able to determine the location of transponder 38 in the hoistway 12. Thus, the decoder module 44 maps values stored in memory 48 that represent locations in the hoistway and compares the identification signal 40 to the values such that the elevator position determination system can determine the elevator car position in response to the identification signal 40.

Figure 4:
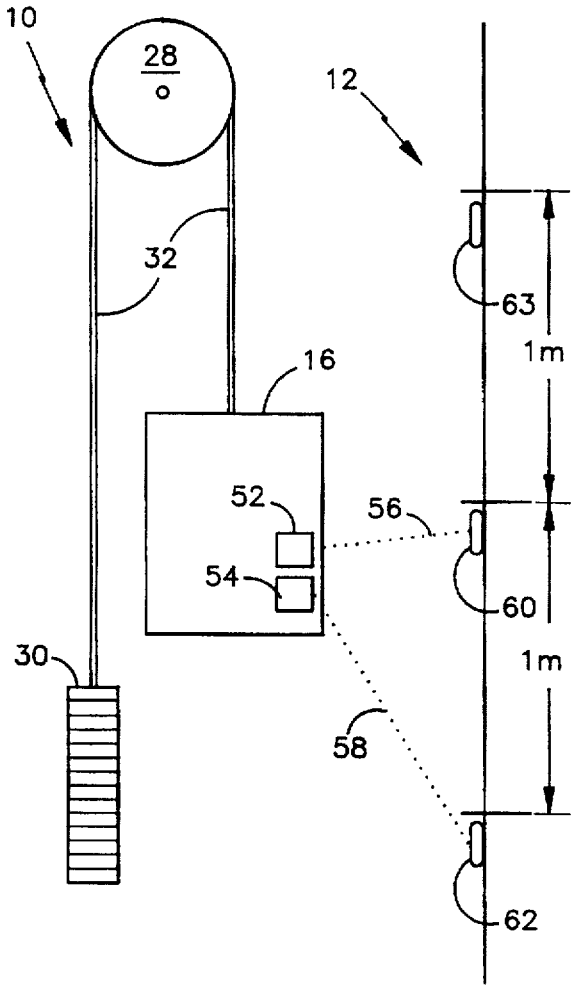
FIG. 4 is a functional block diagram of a system for elevator position determination embodying the principles of the present invention.

Referring to FIG. 4, another alternative approach includes multiple transponders that provide multiple frequency identification signals. For example, two transceivers 52, 54 are adjacently disposed on the elevator car 16 such that each transceiver 52, 54 is responsive to an identification signal with a different frequency. A first transceiver 52 is responsive to a first identification signal 56 transmitted on a first frequency and a second transceiver 54 is responsive to a second identification signal 58 transmitted on a second frequency. First transponders 60 that transmit the first identification signal 56 are disposed in the hoistway 12 adjacent to second transponders 62, 63 that transmit the second identification signal 58. In this arrangement the position resolution is dependent on the identification signal strength of the transponders 60, 62, 63. For example, the transponders 60, 62 may be separated by one meter for transponders 60, 62 with a one meter identification signal range. This arrangement provides that a maximum of one transponder 60 transmitting the first identification signal 56 and one transponder 62 transmitting the second identification signal 58 can be detected by the transceivers 52, 54 at any instant of time. For example, as shown in FIG. 4, transceiver 52 is responsive to one transponder 60 transmitting the first identification signal 56 and transceiver 54 is responsive to one transponder 62 transmitting the second identification signal 58. Each identification signal 56, 58 has a position indication value corresponding to the position of its associated transponder 60, 62. The first transceiver 52 is not responsive to transponder 63 because the identification signal of transponder 63 is transmitted on the second frequency. The second transceiver 54 is not responsive to transponder 63 because the distance between the second transceiver 54 and transponder 63 is greater than the identification signal range. Thus, this embodiment provides increased position resolution by allowing transponders that provided identification signals with different frequencies to be disposed in a staggered manner in the hoistway. For a additional increase in resolution additional identification signals with different frequencies may be used. The query signal, in this arrangement, may be provided by one or all of the transceivers. For example, in one embodiment only the first transceiver 52 transmits the query signal and the second transceiver 54 is replaced by a receiver responsive to the second identification signal 58. The receiver is equivalent to the second transceiver 54 except the receiver does not transmit the query signal. Thus, the receiver does not include circuitry associated with transmitting the query signal.

Figure 5:
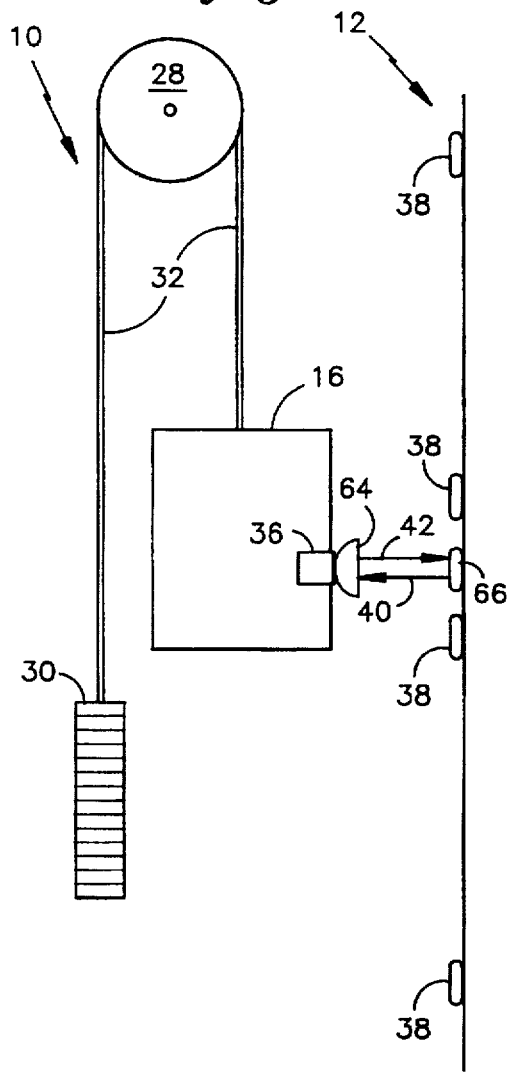
FIG. 5 is a functional block diagram of a system for elevator position determination embodying the principles of the present invention.

Referring to FIG. 5, another alternative approach includes a directional antenna 64 disposed on the transceiver 36. The directional antenna 64 may alternatively be disposed on the transponders. In a preferred embodiment, the directional antenna 64 is an elliptical antenna; alternatively, a parabolic antenna may be used as the directional antenna 64. The directional antenna 64 is arranged and dimensioned such that a directivity of the antenna 64 permits transmission of the query signal 42 only to the nearest transponder 66. Such arrangements and dimensions would be apparent to those skilled in the art when taken in combination with the instant specification and need not be further discussed. Thus, given the elevator car's position in the hoistway 12 as shown in FIG. 5, only one transponder 66 transmits its identification signal 40 in response to the transceiver's query signal 42. The remaining transponders 38 are not within a range of the query signal 42 and thus do not transmit identification signals 40 to the transceiver 36. This approach allows the transponders to be placed proximal with respect to each other in the hoistway 12; which in turn provides an increased position resolution. The transponder separation is determined by the directivity of the directional antenna at a given power.

Use of the directional antenna 64 also provides increased position accuracy because the detection range of the transponders 38 by the transceiver 36 is reduced as a result of the directional antenna's directivity. Consequently, one transponder 38 may be placed at each floor, as described above, and used as an indication of whether the elevator car 16 is level with a particular landing.

Various changes to the above description may be made without departing from the spirit and scope of the present invention as would be obvious to one of ordinary skill in the art of the present invention.

What is claimed is:

1. An elevator position determination system for determining a position of an elevator car disposed in an elevator hoistway, said elevator position determination system comprising:

a transceiver disposed on the elevator car, said transceiver generating a query signal; and a transponder disposed in the elevator hoistway, said transponder providing an identification signal in response to the query signal, said identification signal comprising a position indication value that is indicative of a position of said transponder in the elevator hoistway;

wherein, said elevator position determination system determines the elevator car position in response to the identification signal.

2. The elevator position determination system for determining a position of an elevator car disposed in an elevator hoistway as recited in claim 1 wherein said transponder is disposed in the elevator hoistway adjacent to a landing.

3. The elevator position determination system for determining a position of an elevator car disposed in an elevator hoistway as recited in claim 2 wherein said identification signal comprises a floor indication value that is indicative of a floor in the elevator hoistway.

4. The elevator position determination system for determining a position of an elevator car disposed in an elevator hoistway as recited in claim 1, further comprising a directional antenna disposed on said transceiver.

5. The elevator position determination system for determining a position of an elevator car disposed in an elevator hoistway as recited in claim 1, further comprising a directional antenna disposed on said transponder.

6. An elevator position determination system for determining a position of an elevator car disposed in an elevator hoistway, said elevator position determination system comprising:

a transceiver disposed on the elevator car, said transceiver generating a query signal;

a transponder disposed in the elevator hoistway, said transponder providing an identification signal in response to the query signal, said identification signal comprising a position indication value that is indicative of a position of said transponder in the elevator hoistway; and a decoder module for receiving and decoding the identification signal;

wherein, said elevator position determination system determines the elevator car position in response to the identification signal.

7. The elevator position determination system for determining a position of an elevator car disposed in an elevator hoistway as recited in claim 6 wherein said decoder module decodes the identification signal by comparing a value of the identification signal to values stored in a look-up table in a memory that correspond to specific floors in a building.

8. The elevator position determination system for determining a position of an elevator car disposed in an elevator hoistway as recited in claim 6 wherein said transponder is disposed in the elevator hoistway adjacent to a landing.

9. The elevator position determination system for determining a position of an elevator car disposed in an elevator hoistway as recited in claim 8 wherein said identification signal comprises a floor indication value that is indicative of a floor in the elevator hoistway.

10. The elevator position determination system for determining a position of an elevator car disposed in an elevator hoistway as recited in claim 6, further comprising a directional antenna disposed on said transceiver.

11. The elevator position determination system for determining a position of an elevator car disposed in an elevator hoistway as recited in claim 6, further comprising a directional antenna disposed on said transponder.

12. An elevator position determination system for determining a position of an elevator car disposed in an elevator hoistway, said elevator position determination system comprising:

a first transceiver disposed on the elevator car, said first transceiver being responsive to a first identification signal;

a second transceiver disposed on the elevator car, said second transceiver being responsive to a second identification signal;

a first transponder disposed in the elevator hoistway, said first transponder providing the first identification signal in response to a query signal provided by at least one of said transceivers; and a second transponder disposed in the elevator hoistway, said second transponder providing the second identification signal in response to the query signal provided by at least one of said transceivers;

wherein, the first and second identification signals are transmitted on a first and second frequency respectively and said elevator position determination system determines the elevator car position in response to the first and second identification signals.

13. The elevator position determination system for determining a position of an elevator car disposed in an elevator hoistway as recited in claim 12 wherein said first and second identification signals comprises a position indication value that is indicative of a position of said transponder in the elevator hoistway.

14. An elevator position determination system for determining a position of an elevator car disposed in an elevator hoistway, said elevator position determination system comprising:

a transceiver disposed on the elevator car, said transceiver being responsive to a first identification signal;

a receiver disposed on the elevator car, said receiver being responsive to a second identification signal;

a first transponder disposed in the elevator hoistway, said first transponder providing the first identification signal in response to a query signal provided by said transceiver; and a second transponder disposed in the elevator hoistway, said second transponder providing the second identification signal in response to the query signal provided by said transceiver;

wherein, the first and second identification signals are transmitted on a first and second frequency respectively and said elevator position determination system determines the elevator car position in response to the first and second identification signals.

15. The elevator position determination system for determining a position of an elevator car disposed in an elevator hoistway as recited in claim 14 wherein said first and second identification signals comprises a position indication value that is indicative of a position of said transponder in the elevator hoistway.

16. An elevator system disposed in a building having a plurality of floors, the building having a hoistway with a plurality of landings that correspond to the plurality of floors, said elevator system comprising:

an elevator car disposed in the hoistway for movement therein;

an elevator controller for providing system control of said elevator system and for providing a control signal;

a motive apparatus for providing movement of said elevator car within the hoistway, said motive apparatus being responsive to the control signal;

a transceiver disposed on said elevator car, said transceiver generating a query signal; and a transponder disposed in the elevator hoistway, said transponder providing an identification signal in response to the query signal, said identification signal comprising a position indication value that is indicative of a position of said transponder in the elevator hoistway;

wherein, said elevator controller determines the elevator car position in response to the identification signal.

17. A method of determining a position of an elevator car disposed in a hoistway, comprising the steps of:

transmitting a query signal by a transceiver disposed on the elevator car;

receiving the query signal by a transponder disposed in the hoistway;

transmitting an identification signal in response to the query signal by the transponder, said identification signal comprising a position indication value that is indicative of a position of said transponder in the elevator hoistway;

receiving the identification signal by the transceiver; and determining the elevator car position in response to the identification signal.

18. The method of determining a position of an elevator car disposed in a hoistway as recited in claim 17, further comprising the step of decoding the identification signal prior to said determining step.

19. An elevator position determination system for determining a position of an elevator car disposed in an elevator hoistway, said elevator position determination system comprising:

a transceiver disposed on the elevator car, said transceiver generating a query signal; and a transponder disposed in the elevator hoistway adjacent to a landing, said transponder providing an identification signal in response to the query signal;

wherein, said elevator position determination system determines the elevator car position in response to the identification signal.

20. The elevator position determination system for determining a position of an elevator car disposed in an elevator hoistway as recited in claim 19 wherein said identification signal comprises a floor indication value that is indicative of a floor in the elevator hoistway.

21. An elevator position determination system for determining a position of an elevator car disposed in an elevator hoistway, said elevator position determination system comprising:

a transceiver disposed on the elevator car, said transceiver generating a query signal; and a transponder disposed in the elevator hoistway, said transponder providing an identification signal in response to the query signal, said identification signal comprises a floor indication value that is indicative of a floor in the elevator hoistway;

wherein, said elevator position determination system determines the elevator car position in response to the identification signal.

22. An elevator position determination system for determining a position of an elevator car disposed in an elevator hoistway, said elevator position determination system comprising:

a transceiver disposed on the elevator car, said transceiver generating a query signal;

a directional antenna disposed on said transceiver; and a transponder disposed in the elevator hoistway, said transponder providing an identification signal in response to the query signal;

wherein, said elevator position determination system determines the elevator car position in response to the identification signal.

23. An elevator position determination system for determining a position of an elevator car disposed in an elevator hoistway, said elevator position determination system comprising:

a transceiver disposed on the elevator car, said transceiver generating a query signal;

a transponder disposed in the elevator hoistway, said transponder providing an identification signal in response to the query signal; and a decoder module for receiving and, decoding the identification signal, said decoder module decodes the identification signal by comparing a value of the identification signal to values stored in a look-up table in a memory that correspond to specific floors in a building;

wherein, said elevator position determination system determines the elevator car position in response to the identification signal.

24. An elevator position determination system for determining a position of an elevator car disposed in an elevator hoistway, said elevator position determination system comprising:

a transceiver disposed on the elevator car, said transceiver generating a query signal;

a transponder disposed in the elevator hoistway adjacent to a landing, said transponder providing an identification signal in response to the query signal; and a decoder module for receiving and decoding the identification signal;

wherein, said elevator position determination system determines the elevator car position in response to the identification signal.

25. An elevator position determination system for determining a position of an elevator car disposed in an elevator hoistway, said elevator position determination system comprising:

a transceiver disposed on the elevator car, said transceiver generating a query signal;

a transponder disposed in the elevator hoistway, said transponder providing an identification signal in response to the query signal, said identification signal comprises a floor indication value that is indicative of a floor in the elevator hoistway; and a decoder module for receiving and decoding the identification signal;

wherein, said elevator position determination system determines the elevator car position in response to the identification signal.

26. An elevator position determination system for determining a position of an elevator car disposed in an elevator hoistway, said elevator position determination system comprising:

a transceiver disposed on the elevator car, said transceiver generating a query signal;

a directional antenna disposed on said transceiver;

a transponder disposed in the elevator hoistway, said transponder providing an identification signal in response to the query signal; and a decoder module for receiving and decoding the identification signal;

wherein, said elevator position determination system determines the elevator car position in response to the identification signal.

* * * * *